US006903539B1

(12) United States Patent
Hoon et al.

(10) Patent No.: US 6,903,539 B1
(45) Date of Patent: Jun. 7, 2005

(54) REGULATED CASCODE CURRENT SOURCE WITH WIDE OUTPUT SWING

(75) Inventors: SiewKuok Hoon, Dallas, TX (US); Jun Chen, Allen, TX (US)

(73) Assignee: Texas Instruments Incorporated, Dallas, TX (US)

( * ) Notice: Subject to any disclaimer, the term of this patent is extended or adjusted under 35 U.S.C. 154(b) by 19 days.

(21) Appl. No.: 10/716,958

(22) Filed: Nov. 19, 2003

(51) Int. Cl.[7] ..... G05F 3/16

(52) U.S. Cl. ..... 323/315; 327/530; 327/362

(58) Field of Search ..... 326/115, 112, 326/119, 121, 126, 127; 327/530, 538, 362, 307, 374, 543; 323/315, 316

(56) References Cited

U.S. PATENT DOCUMENTS 4,583,037 A * 4/1986 Sooch ..... 323/315
5,892,356 A * 4/1999 Chuang ..... 323/315
5,959,446 A * 9/1999 Kuckreja ..... 323/315
6,556,070 B2 * 4/2003 Paulus ..... 327/543

* cited by examiner

*Primary Examiner*—Vibol Tan
(74) *Attorney, Agent, or Firm*—Ronald O. Neerings; Wade James Brady, III; Frederick J. Telecky, Jr.

(57) ABSTRACT

System for a current source with enhanced output impedance. A preferred embodiment comprises a cascode current source arranged in a current mirror configuration (such as current source 600) with a pair of level shifters arranged in a source-follower configuration (such as level shifters 505 and 510). The level shifters reduce the compliance voltage of the current source, permitting use in low voltage applications.

27 Claims, 5 Drawing Sheets

REGULATED CASCODE CURRENT SOURCE WITH WIDE OUTPUT SWING

TECHNICAL FIELD

The present invention relates generally to circuit design, and more particularly to a or a current source with enhanced output impedance.

BACKGROUND

An ideal current source has infinite output impedance and, as a result, provides a constant current over a wide operating voltage range. However, in reality, current sources have finite output impedance and limited output voltage swing. Furthermore, in low voltage applications, a low compliance voltage, Vcompl, may be desired to minimize the output voltage overhead.

A commonly used solution to maximize the output impedance involves the use of a regulated cascode current source. The regulated cascode current source offers the desired high output impedance. Another solution involves the use of an operational amplifier to enhance the regulated cascode current source. The use of the operational amplifier reduces the compliance voltage, Vcompl, which can make the design more suitable for low voltage applications.

One disadvantage of the prior art is that the regulated cascode current source suffers from a high compliance voltage, Vcompl, the voltage needed to avoid triode region operation. The high value of the compliance voltage, Vcompl, can prevent the use of the regulated cascode current source in low voltage applications.

A second disadvantage of the prior art is that the operational amplifier enhanced regulated cascode source requires a high gain operational amplifier, which can increase component count and overall limit on the bandwidth of the current source.

SUMMARY OF THE INVENTION

These and other problems are generally solved or circumvented, and technical advantages are generally achieved, by preferred embodiments of the present invention which provides a regulated cascode current source with a wide output voltage swing.

In accordance with a preferred embodiment of the present invention, a current source comprising a first stage coupled to an input current source, the first stage containing circuitry to receive an input current provided by the input current source, a second stage coupled to the first stage, the second stage comprising a first transistor and a second transistor serially coupled together, wherein a first terminal of the second transistor is coupled to a second terminal of the first transistor, a third transistor having a first terminal coupled to a third terminal of the first transistor, and a level shifter coupled to a third terminal of the third transistor and the first terminal of the second transistor, the level shifter containing circuitry to elevate a voltage at a third terminal of the second transistor, wherein the level shifter is arranged in a source-follower configuration is provided.

In accordance with another preferred embodiment of the present invention, a current source comprising a first stage coupled to an input current source, the first stage comprising a first transistor and a second transistor serially coupled together, wherein a first terminal of the second transistor is coupled to a second terminal of the first transistor, a third transistor having a first terminal coupled to a third terminal of the first transistor, a second level shifter coupled to a third terminal of the third transistor and the first terminal of the second transistor, the second level shifter containing circuitry to elevate a voltage at a third terminal of the second transistor, the current source further comprising a second stage coupled to the first stage, the second stage comprising a fourth transistor and a fifth transistor serially coupled together, wherein a first terminal of the fifth transistor is coupled to a second terminal of the fourth transistor, a sixth transistor having a first terminal coupled to a third terminal of the fourth transistor, and a level shifter coupled to a third terminal of the sixth transistor and the first terminal of the fifth transistor, the level shifter containing circuitry to elevate a voltage at a third terminal of the fifth transistor, wherein the level shifter is arranged in a source-follower configuration is provided.

In accordance with another preferred embodiment of the present invention, a current source comprising a first stage coupled to an input current source, the first stage containing circuitry to receive an input current provided by the input current source, a second stage coupled to the first stage, the second stage comprising a first transistor and a second transistor serially coupled together, wherein a first terminal of the second transistor is coupled to a second terminal of the first transistor, a level shifter coupled to a third terminal of the second transistor and a second terminal of the first transistor, the level shifter containing circuitry to elevate a voltage at the third terminal of the second transistor, wherein the level shifter is arranged in a source follower configuration, and a third transistor having a third terminal coupled to the level shifter is provided.

An advantage of a preferred embodiment of the present invention is that the current source has a high output impedance which provides for a wide output voltage range.

A further advantage of a preferred embodiment of the present invention is that the current source has a low compliance voltage, permitting use in low voltage applications.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context, namely a regulated cascode current source with a large output voltage swing for use in wireless devices. The invention may also be applied, however, to other applications wherein a large output voltage swing is desirable, along with low voltage considerations.

Figure 1:
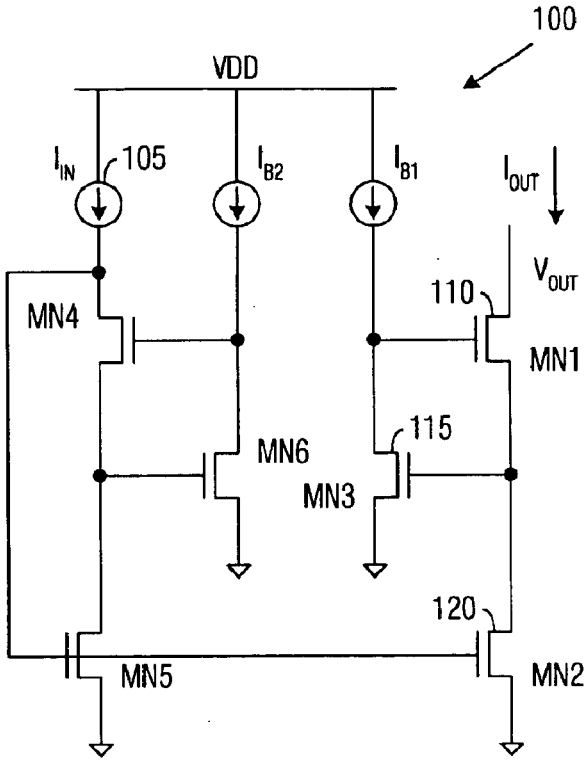
Fig. 1 (Prior Art)
FIG. 1 is a diagram of a prior art regulated cascode current source.

With reference now to FIG. 1, there is shown diagram illustrating a prior art regulated cascode current source 100 arranged in a current mirror configuration with a large output impedance. The output (current, $I_{OUT}$, and voltage, $V_{OUT}$) of the regulated cascode current source 100 (or current source) can be regulated by the magnitude of an input current ($I_{IN}$ 105). The output voltage, $V_{OUT}$, of the current source 100 may have a minimum allowable value to prevent the current source from operating in triode region operation and can be expressed as:

$$V_{OUT,MIN}=V_{T,N3}+V_{DSAT,N3}+V_{DSAT,N1}=V\text{compl}$$

wherein, $V_{DSAT,N1}$ is the saturation voltage of transistor MN1 110, $V_{DSAT,N3}$ is the saturation voltage of transistor MN3 115, and $V_{T,N3}$ is the threshold voltage of transistor MN3 115. Note that $V_{DSAT,N1}$ may be expressed as $V_{GS,N1}-V_{T,N1}$ of the transistor MN1 110, wherein $V_{GS}$ is the gate-source voltage. The output impedance ($R_{OUT}$) of the current source 100 may be approximated with the expression:

$$R_{OUT}=(g_{m1}*g_{m2}*r_{ds1}*r_{ds2}*r_{ds3})/2$$

wherein, $g_{m1}$ is the transconductance of transistor MN1 110, $g_{m2}$ is the transconductance of transistor MN2 120, $r_{ds1}$ is the source-drain resistance of transistor MN1 110, $r_{ds2}$ is the source-drain resistance of transistor MN2 120, $r_{ds3}$ is the source-drain resistance of transistor MN3 115. Clearly, the output impedance of the current source 100 is large, but the current source 100 may not be suitable for low voltage applications due to its high compliance voltage, Vcompl.

Figure 2:
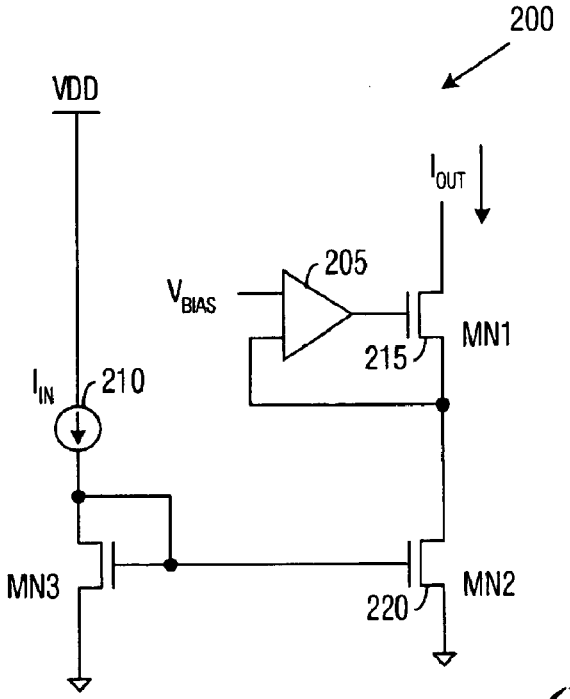
Fig. 2 (Prior Art)
FIG. 2 is a diagram of a prior art regulated cascode current source with an operation amplifier enhancement.

With reference now to FIG. 2, there is shown a diagram illustrating a prior art regulated cascode current source 200 with an operational amplifier (op-amp) 205 enhancement to help reduce the compliance voltage, Vcompl. Once again, the output of the current source 200 can be regulated by an input current ($I_{IN}$ 210). The op-amp 205 may be used to control the state of a transistor MN1 215. For example, the op-amp 205 may compare a voltage against a bias voltage, with the output of the op-amp 205 controlling the voltage at the gate of the transistor MN1 215. With the addition of the op-amp 205, the compliance voltage, Vcompl, can be expressed as:

$$V\text{compl}=V_{DSAT,N2}+V_{DSAT,N1}$$

wherein, $V_{DSAT,N2}$ is the saturation voltage of transistor MN2 220 and $V_{DSAT,N1}$ is the saturation voltage of transistor MN1 215. Hence, the Vcompl of the current source 200 can be lower than the Vcompl of the current source 100 due to the absence of the $V_{T,N3}$ (from FIG. 1). The output impedance ($R_{OUT}$) of the current source 200 may be approximated with the expression:

$$R_{OUT}=g_{m1}*r_{ds1}*r_{ds2}*(1+A)$$

wherein, $g_{m1}$ is the transconductance of the transistor MN1 215, $r_{ds1}$ is the source-drain resistance of the transistor MN1 215, $r_{ds2}$ is the source-drain resistance of the transistor MN2 220, and A is the gain of the op-amp 205.

Note that a high-gain op-amp 205 may be needed to provide suitable output impedance to the current source. Additionally, the use of a high gain op-amp can increase the component count of the current source 200 and can place a limit upon the bandwidth of the current source 200.

Figure 3:
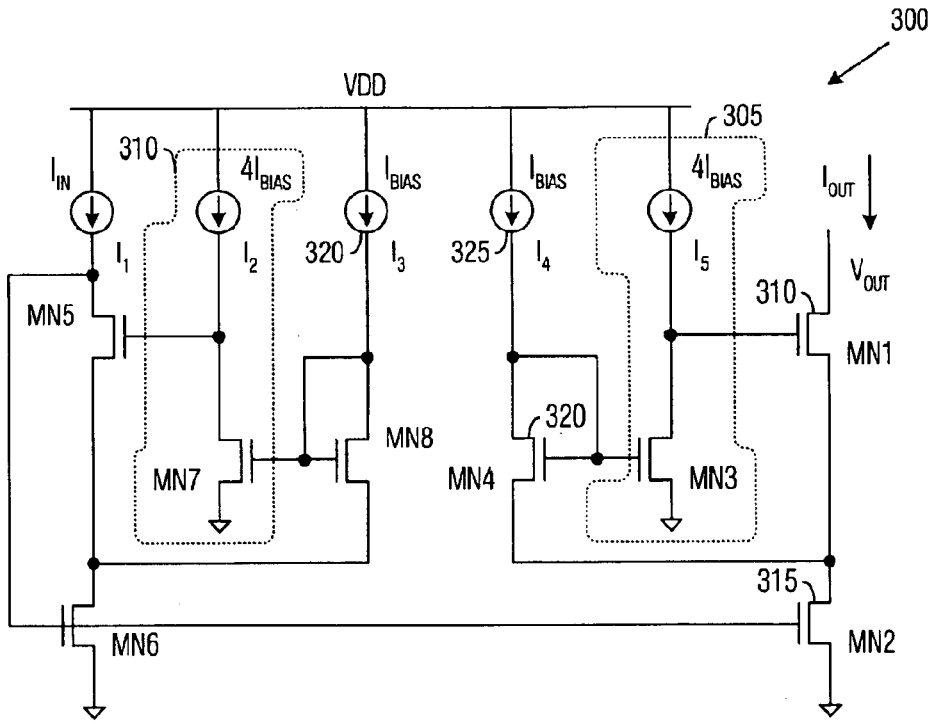
Fig. 3 (Prior Art)
FIG. 3 is a diagram of a prior art regulated cascode current source with a pair of level shifters to reduce compliance voltage.
Figure 4:
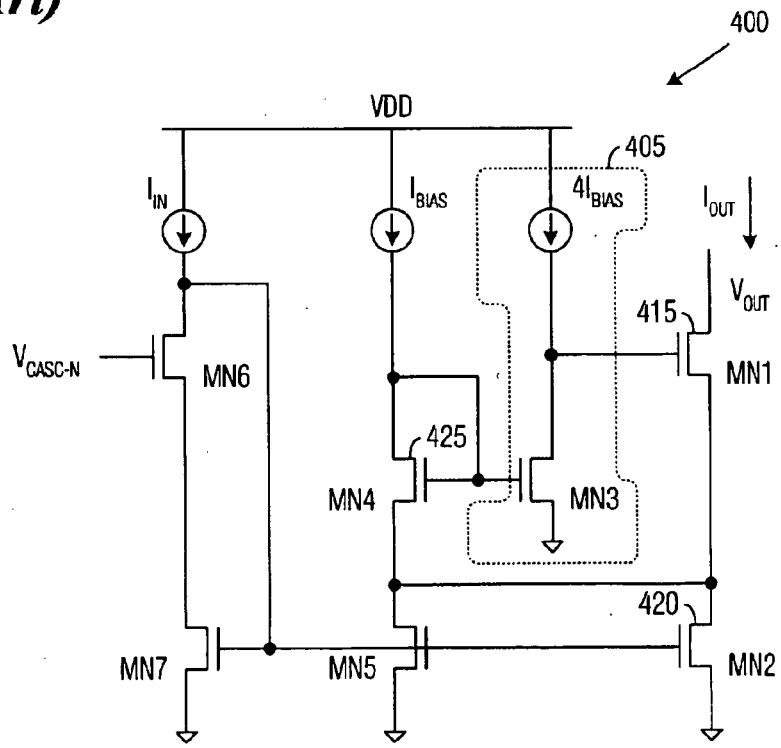
Fig. 4 (Prior Art)
FIG. 4 is a diagram of a prior art regulated cascode current source with a level shifter to reduce compliance voltage.

With reference now to FIGS. 3 and 4, there are shown diagrams illustrating prior art designs of wide-swing cascode current sources 300 and 400. The use of level shifters (level shifters 305 and 310 (FIG. 3) and level shifter 405 (FIG. 4)) can help in reducing the value of the compliance voltage, Vcompl. For both current sources 300 and 400, the compliance voltage, Vcompl, may be expressed as:

$$V\text{compl}=V_{DSAT,N1}+V_{DSAT,N2}$$

wherein, $V_{DSAT,N1}$ is the saturation voltage for transistor MN1 (transistor 310 (FIG. 3) and transistor 415 (FIG. 4)) and $V_{DSAT,N2}$ is the saturation voltage for transistor MN2 (transistor 315 (FIG. 3) and transistor 420 (FIG. 4)). For both current sources, output impedance is similar to the output impedance of the current source 100 ($R_{OUT}=(g_{m1}*g_{m2}*r_{ds1}*r_{ds2}*r_{ds3})/2$). Vcompl can be reduced with the presence of the level shifter as the gate terminal voltage of MN1 can be biased such that its source terminal voltage can be pushed as low as $V_{DSAT,N1}$, before the entire current source goes out of saturation.

However, in the case of the current source 300 (FIG. 3), the best current mirror performance may be achieved when an important matching condition is met, the currents $I_3$ (current source 320) and $I_4$ (current source 325) should match. Since $I_1+I_3=I_4+I_{OUT}$, then $I_{OUT}=(I_1+I_3)-I_4$. Therefore, in order for $I_{OUT}=I_1$, $I_3$, should match $I_4$. If $I_3$ and $I_4$ are poorly matched, the current mirroring accuracy can be impacted significantly. A similar matching situation can be present in the current source 400 (FIG. 4).

Figure 5A:
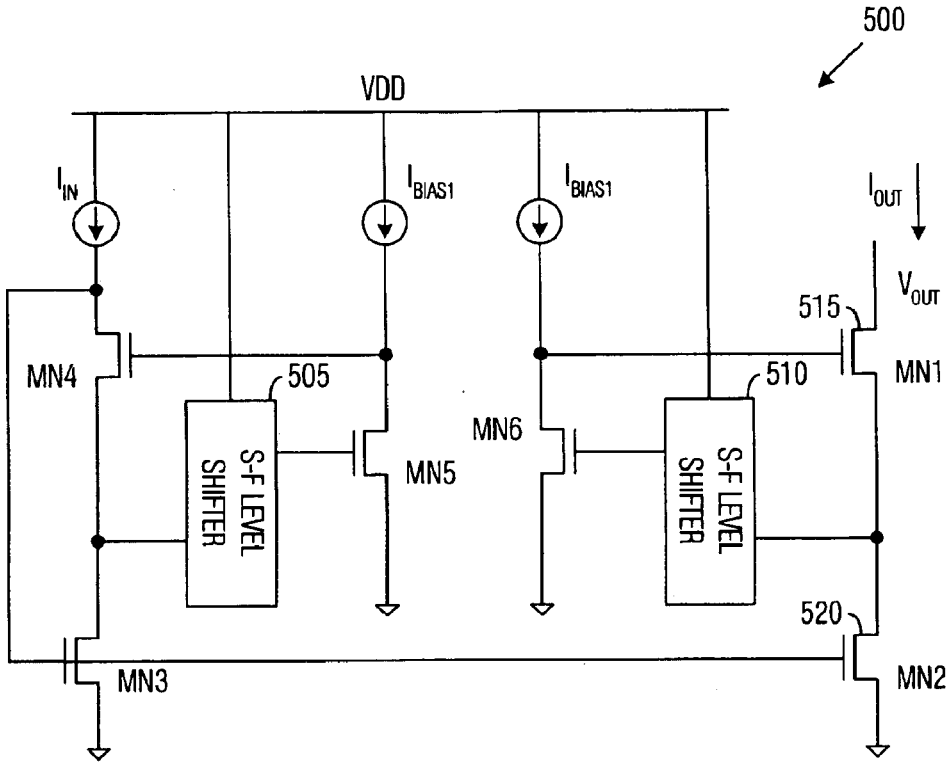
FIGS. 5*a* and 5*b* are diagrams of a wide-swing regulated cascode current source with a pair of level shifters in a source-follower configuration, according to a preferred embodiment of the present invention.

With reference now to FIG. 5*a,* there is shown a diagram illustrating a wide-swing cascode current source 500, wherein the current source 500 features a high output impedance and a low compliance voltage, according to a preferred embodiment of the present invention. The current source 500 makes use of a pair of source-follower (S-F) level shifters 505 and 510 to help reduce the compliance voltage, Vcompl. With the use of the S-F level shifters 505 and 510, the compliance voltage, Vcompl, can be as low as $Vcompl=V_{DSAT,N1}+V_{DSAT,N2}$, wherein $V_{DSAT,N1}$ is the saturation voltage for transistor MN1 515 and $V_{DSAT,N2}$ is the saturation voltage for transistor MN2 520. The output impedance of the current source 500 can be similar to the output impedance of the current source 300 (FIG. 3), namely, $R_{OUT}=(g_{m1}*g_{m2}*r_{ds1}*r_{ds2}*r_{ds3})/2$.

Figure 5B:
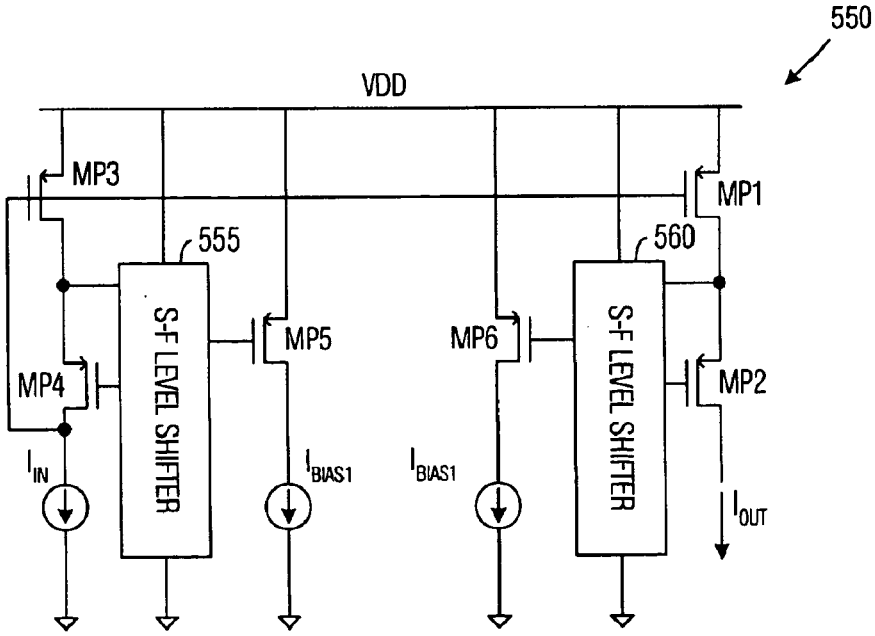

With reference now to FIG. 5*b,* there is shown a diagram illustrating a wide-swing cascode current source 550, wherein the current source 550 features a high output impedance and a low compliance voltage, according to a preferred embodiment of the present invention. The current source 550 can be similar to the current source 500 (FIG. 5*a*) in that it makes use of a pair of S-F level shifters 555 and 560 to help reduce the compliance voltage, Vcompl. However, rather than using NMOS transistors, the current source 550 makes use of PMOS transistors.

Figure 6A:
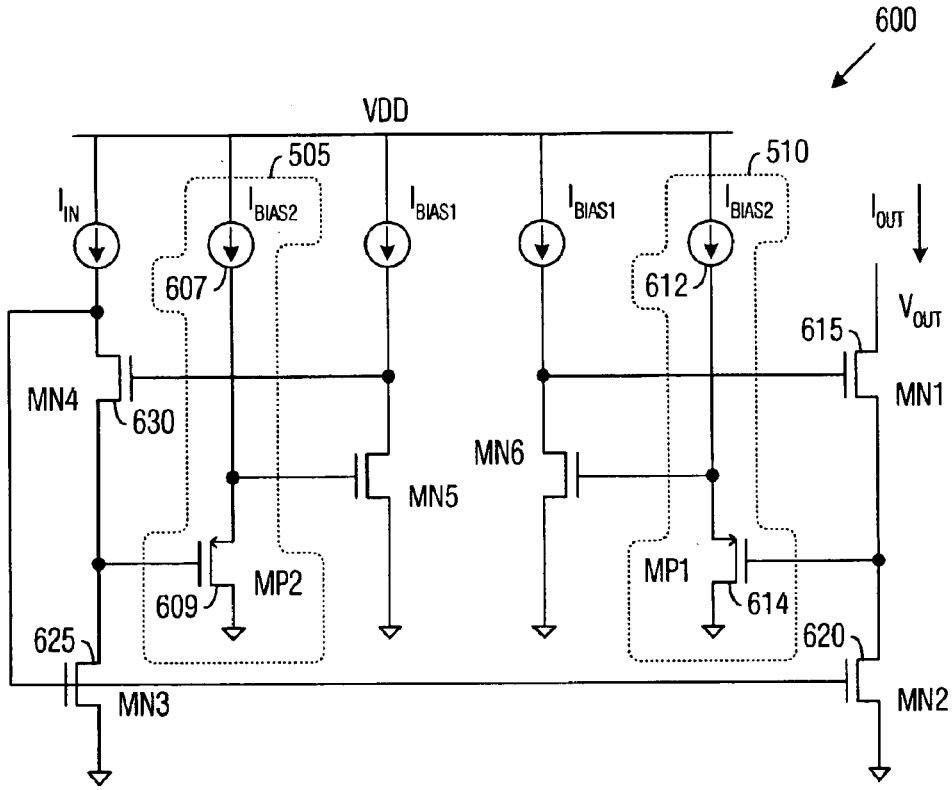
FIG. 6*a* is a diagram of a wide-swing regulated cascode current source with a pair of level shifters made from P-type MOSFETs in a source-follower configuration, according to a embodiment of the present invention.
Figure 6B:
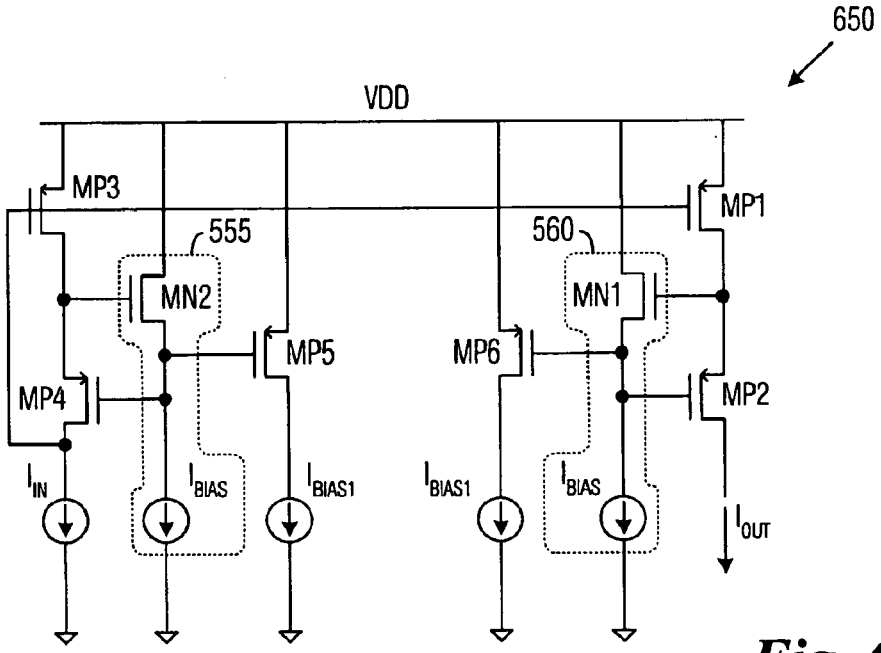
FIG. 6*b* is a diagram of a wide-swing regulated cascode current source with a pair of level shifters made from N-type MOSFETs in a source-follower configuration, according to a preferred embodiment of the present invention.

With reference now to FIG. 6*a,* there is shown a diagram illustrating a wide-swing cascode current source 600, wherein the current source 600 features a high output impedance and a low compliance voltage, according to a preferred embodiment of the present invention. As displayed in FIG. 6*a,* the S-F level shifters 505 and 510 may be constructed out of current sources 607 and 612 and P-type MOSFET transistors 609 and 614. Note that the S-F level shifters 505 and 510 are arranged in a source-follower configuration with transistors in the current source 600. The compliance voltage can be reduced with the help of a level shifter since it allows the drain terminal voltage of transistor MN2 620 to be lowered and fixed at a certain low voltage such as $V_{DSAT,N2}$, which is also the source terminal voltage of transistor MN1 615. The normal level shifter configuration in current source 300 (FIG. 3) and 400 (FIG. 4) can pose a problem in $I_{OUT}$ accuracy as the biasing currents in the level shifters would constitute part of $I_{OUT}$. Thus, $I_{OUT}$ accuracy depends heavily on the matching of the level shifters. However, the current source in 500 (FIG. 5) may not play a part in the $I_{OUT}$ equation. The level shifters 505 and 510 can merely provide the function of proper biasing for the transistors MN1 615, MN2 620, MN3 625 and MN4 630. In FIG. 6*a*, the current source may be present for NMOS sinking current source configuration. A PMOS sourcing current source 650 can be implemented by using a complementary architecture as shown in FIG. 6*b*.

Figure 7:
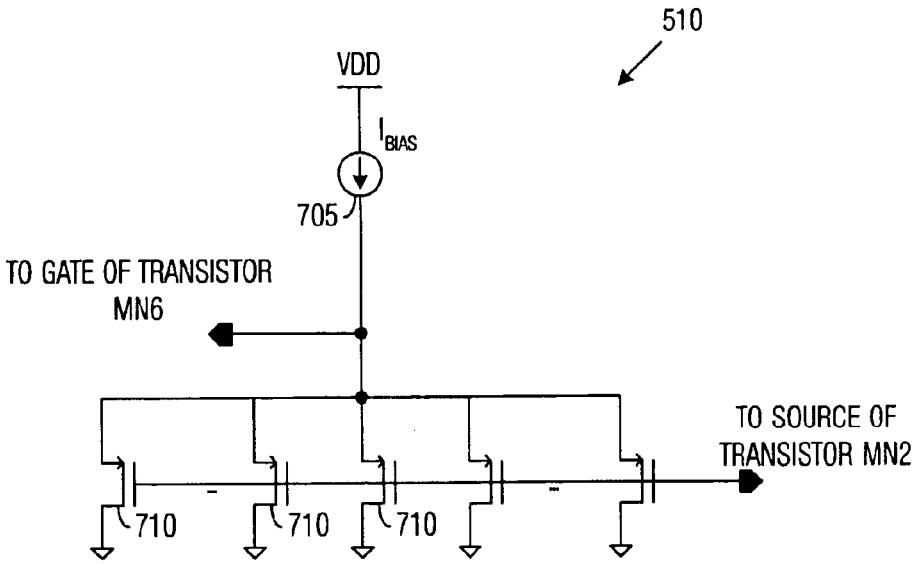
FIG. 7 is a diagram of a level shifter made from a plurality of P-type MOSFETs, according to a preferred embodiment of the present invention.

With reference now to FIG. 7, there is shown a diagram illustrating a source-follower level shifter 510, according to a preferred embodiment of the present invention. The S-F level shifter 510, as displayed in FIG. 7, illustrates an alternative preferred embodiment of the present invention. In FIG. 6*a,* the S-F level shifter 510 was shown with a single P-type MOSFET transistor (transistor MP1 614). However, in certain situations, such as when $I_{BIAS}$ (current source 705) is large, the presence of multiple P-type MOSFET transistors (transistors 710) arranged in parallel can sink the large $I_{BIAS}$. The use of the multiple transistors in parallel can be useful in a low power design. Note that a similar embodiment using N-type MOSFET transistors can be possible with the S-F level shifter 560 (FIG. 6*b*).

Figure 8:
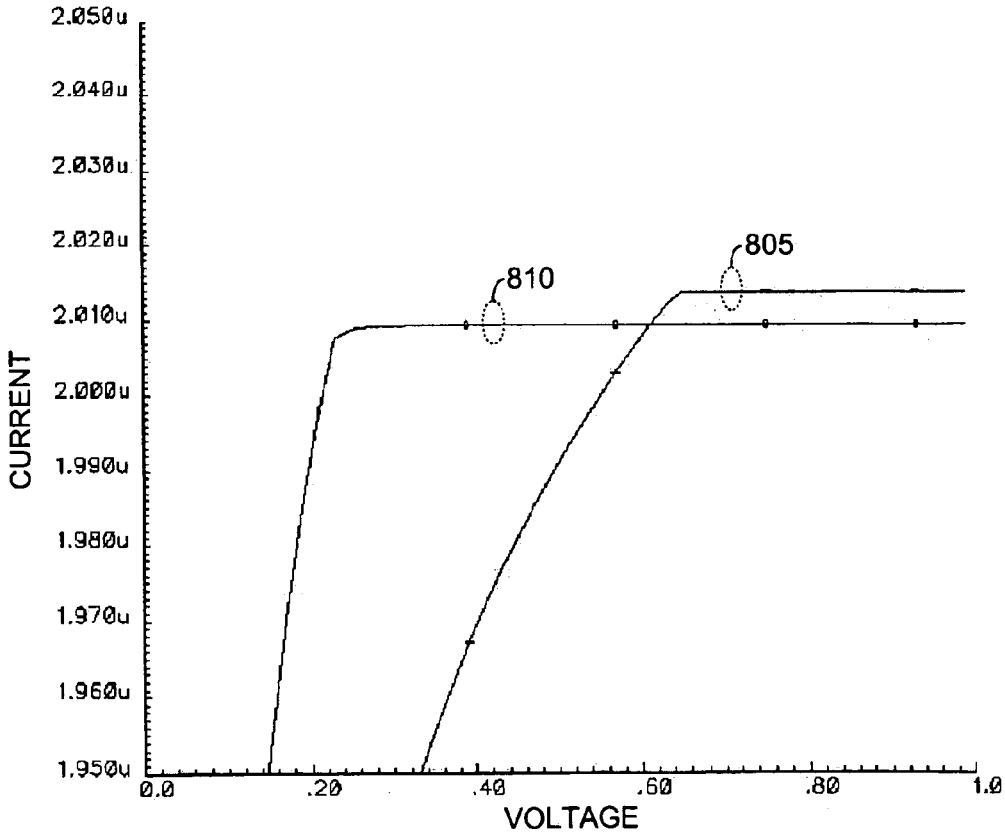
FIG. 8 is a data plot of output current versus output voltage for a prior art regulated cascode current source and a wide-swing regulated cascode current source, according to a preferred embodiment of the present invention.

With reference now to FIG. 8, there is shown a data plot illustrating a comparison of output current versus output voltage for a prior art current source (such as current source 100 displayed in FIG. 1) and for a wide-swing current source (such as current source 600 displayed in FIG. 6*a*), according to a preferred embodiment of the present invention. A first curve 805 displays the output current versus output voltage for the prior art current source, while a second curve 810 displays the output current versus output voltage for the wide-swing current source. For both curves, above a certain voltage (different for each curve), the output current becomes stable. This voltage is the compliance voltage, Vcompl. For the prior art current source (the first curve 805), the compliance voltage is approximately 0.6 volts while for the wide-swing current source (the second curve 810), the compliance voltage is approximately 0.2 volts. Since the output currents for both curves level off at approximately the same level, output impedance of the two current sources are similar.

Although the present invention and its advantages have been described in detail, it should be understood that various changes, substitutions and alterations can be made herein without departing from the spirit and scope of the invention as defined by the appended claims.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A current source comprising:

a first stage coupled to an input current source, the first stage containing circuitry to receive an input current provided by the input current source;

a second stage coupled to the first stage, the second stage comprising:

a first transistor and a second transistor serially coupled together, wherein a first terminal of the second transistor is coupled to a second terminal of the first transistor;

a third transistor having a first terminal coupled to a third terminal of the first transistor; and a level shifter coupled to a third terminal of the third transistor and the first terminal of the second transistor, the level shifter containing circuitry to elevate a voltage at a third terminal of the second transistor, wherein the level shifter is arranged in a source-follower configuration.

2. The current source of claim 1, wherein the level shifter comprises a fourth transistor having a first terminal coupled to the third terminal of the third transistor and a third terminal coupled to the first terminal of the second transistor.

3. The current source of claim 2, wherein the first, second, and third transistors are N-type MOSFET (metal-oxide semiconductor field-effect transistors), and wherein the fourth transistor is a P-type MOSFET.

4. The current source of claim 2, wherein a first current source is coupled between a substrate power supply and the first terminal of the third transistor and a second current source is coupled between the substrate power supply and the first terminal of the fourth transistor.

5. The current source of claim 4, wherein the first current source provides a first current that is approximately four times a second current provided by the second current source.

6. The current source of claim 1, wherein the level shifter comprises a plurality of transistors coupled in parallel, wherein each transistor has a first terminal coupled to the third terminal of the third transistor and a third terminal coupled to the first terminal of the second transistor.

7. The current source of claim 6, wherein each transistor in the plurality of transistors are P-type MOSFET (metal-oxide semiconductor field-effect transistors).

8. The current source of claim 6, wherein each transistor in the plurality of transistors have identical geometries.

9. The current source of claim 1, wherein the first stage comprises:

a fifth transistor and a sixth transistor serially coupled together, wherein a first terminal of the sixth transistor is coupled to a second terminal of the fifth transistor;

a seventh transistor having a first terminal coupled to a third terminal of the fifth transistor; and a second level shifter coupled to a third terminal of the seventh transistor and the first terminal of the sixth transistor, the second level shifter containing circuitry to elevate a voltage at a third terminal of the sixth transistor.

10. The current source of claim 9, wherein the second level shifter is arranged in a source-follower configuration.

11. The current source of claim 9, wherein the second level shifter comprises an eighth transistor having a first terminal coupled to the third terminal of the seventh transistor and a third terminal coupled to the first terminal of the sixth transistor.

12. The current source of claim 11, wherein the fifth, sixth, and seventh transistors are N-type MOSFET (metal-oxide semiconductor field-effect transistors), and wherein the eighth transistor is a P-type MOSFET.

13. The current source of claim 11, wherein a third current source is coupled between a substrate power supply and the first terminal of the seventh transistor and a fourth current source is coupled between the substrate power supply and the first terminal of the eighth transistor.

14. The current source of claim 13, wherein the third current source provides a third current that is approximately four times a fourth current provided by the fourth current source.

15. The current source of claim 9, wherein the first terminal of the fifth transistor is coupled to the input current source.

16. The current source of claim 1, wherein the first terminal is a source terminal, the second terminal is a drain terminal, and the third terminal is a gate terminal.

17. A current source comprising:

a first stage coupled to an input current source, the first stage comprising:

a first transistor and a second transistor serially coupled together, wherein a first terminal of the second transistor is coupled to a second terminal of the first transistor;

a third transistor having a first terminal coupled to a third terminal of the first transistor;

a second level shifter coupled to a third terminal of the third transistor and the first terminal of the second transistor, the second level shifter containing circuitry to elevate a voltage at a third terminal of the second transistor;

the current source further comprising a second stage coupled to the first stage, the second stage comprising:

a fourth transistor and a fifth transistor serially coupled together, wherein a first terminal of the fifth transistor is coupled to a second terminal of the fourth transistor;

a sixth transistor having a first terminal coupled to a third terminal of the fourth transistor; and a level shifter coupled to a third terminal of the sixth transistor and the first terminal of the fifth transistor, the level shifter containing circuitry to elevate a voltage at a third terminal of the fifth transistor, wherein the level shifter is arranged in a source-follower configuration.

18. The current source of claim 17, wherein the level shifter comprises a seventh transistor having a first terminal coupled to the third terminal of the sixth transistor and a third terminal coupled to the first terminal of the fifth transistor and wherein the second level shifter comprises an eighth transistor having a first terminal coupled to the third terminal of the third transistor and a third terminal coupled to the first terminal of the second transistor.

19. The current source of claim 18, wherein the seventh and the eighth transistors have identical geometries.

20. The current source of claim 17, wherein the level shifter comprises a plurality of transistors coupled in parallel, wherein each transistor has a first terminal coupled to the third terminal of the sixth transistor and a third terminal coupled to the first terminal of the fifth transistor and wherein the second level shifter comprises a second plurality of transistors coupled in parallel, wherein each transistor has a first terminal coupled to the third terminal of the third transistor and a third terminal coupled to the first terminal of the second transistor.

21. The current source of claim 20, wherein each transistor in the plurality of transistors and the second plurality of transistors have identical geometries.

22. The current source of claim 17, wherein the current source is used in a wireless device.

23. A current source comprising:

a first stage coupled to an input current source, the first stage containing circuitry to receive an input current provided by the input current source;

a second stage coupled to the first stage, the second stage comprising:

a first transistor and a second transistor serially coupled together, wherein a first terminal of the second transistor is coupled to a second terminal of the first transistor;

a level shifter coupled to a third terminal of the second transistor and a second terminal of the first transistor, the level shifter containing circuitry to elevate a voltage at the third terminal of the second transistor, wherein the level shifter is arranged in a source-follower configuration; and a third transistor having a third terminal coupled to the level shifter.

24. The current source of claim 23, wherein the level shifter comprises a fourth transistor having a second terminal coupled to the third terminal of the second transistor and to the third terminal of the third transistor.

25. The current source of claim 24, wherein the first, second, and third transistors are P-type MOSFET (metal-oxide semiconductor field-effect transistors), and wherein the fourth transistor is an N-type MOSFET.

26. The current source of claim 24, wherein a first current source is coupled between a substrate ground and the fourth transistor.

27. The current source of claim 23, wherein the first terminal is a source terminal, the second terminal is a drain terminal, and the third terminal is a gate terminal.

* * * * *